US006115060A

United States Patent [19]

Rowley

[11] Patent Number: 6,115,060

[45] Date of Patent: Sep. 5, 2000

[54] THRU-HULL VIDEO CAMERA

[76] Inventor: Steven R. Rowley, 5413 SE. Schooner Oaks Way, Stuart, Fla. 34997

[21] Appl. No.: 09/305,630

[22] Filed: May 5, 1999

Related U.S. Application Data

[63] Continuation-in-part of application No. 09/075,985, May 11, 1998.

[51] Int. Cl.[7] ..... H04N 7/18

[52] U.S. Cl. ..... 348/81; 348/148

[58] Field of Search ..... 348/61, 81, 82, 348/83, 143, 148, 151

[56] References Cited

U.S. PATENT DOCUMENTS

| | | | |
|---|---|---|---|
| 4,346,404 | 8/1982 | Gantenbrink | 348/81 |
| 4,809,630 | 3/1989 | Walker | 114/66 |
| 4,965,601 | 10/1990 | Canty | 348/81 |
| 4,977,418 | 12/1990 | Canty | 348/81 |

*Primary Examiner*—Bryan Tung
*Attorney, Agent, or Firm*—McHale & Slavin

[57] ABSTRACT

The instant invention is a video camera assembly which is adapted to be mounted in a thru-hull fitting so as to allow for safe and dependable viewing in various environments. A primary embodiment of the invention allows for directing the focus of the camera toward alternative fields of view by incorporation of the device within a conventional thru-hull fitting found on most boats. The camera includes a modified transducer body with a self-contained miniaturized camera available for coupling to a television or video monitor in a safe and protected location.

19 Claims, 4 Drawing Sheets

THRU-HULL VIDEO CAMERA

RELATED APPLICATIONS

This application is a continuation-in-part of Ser. No. 09/075,985, filed May 11, 1998, the contents of which are herein incorporated by reference.

FIELD OF THE INVENTION

This invention relates to the field of video cameras; more particularly, to a video camera mounted in a thru-hull fitting, and most particularly to a thru-hull mounted video camera having an adjustable field of view.

BACKGROUND OF THE INVENTION

Various aquatic endeavors, such as fishing, diving, snorkeling and boating in general, make it desirable to be able to view beneath the water's surface. To accomplish this viewing, numerous viewing devices have been utilized from simplistic transparent panels to elaborate electronic devices.

For instance, a basic underwater viewing device can be a rigid transparent panel that is built into the hull of a boat. Such vessels, also known as "glass-bottom boats" are popular with tourists since they allow for a safe and easy way of viewing the world beneath the ocean's surface. However, such transparent panels have limited structural integrity requiring special hull modification and requires viewing directly through the panel.

Various sonar devices, including depth and fish finders have also been used in an effort to create a visual interpretation, based upon sonar feedback, of the underlying geography. This type of information is very important when fishing or when merely trying to navigate through shallow water.

Additionally, during the course of designing or operating a vessel, it is often useful to be able to visualize the flow of water beneath and around the hull. Furthermore, when vessels are underway, untoward vibrations may develop, or it may be suspected that a portion of the running gear has been damaged by debris or grounding of the vessel. In such instances, the ability to visually inspect the propellers and shafts is extremely important.

Modern electronics allow on-board displays of the underwater environment utilizing the signal from a small video camera placed beneath the surface. One known electronic display device employs a camera enclosed in a watertight housing secured to a long handle that allows for positioning of the camera beneath the water surface along the side of the vessel. Alternatively, the camera can be attached to a cable which allows it to be submerged at a specified depth and towed behind the vessel at fairly high speeds, e.g. up to 12 knots,. The problem with these devices is that they necessarily suffer from being dragged through the water. When supported by a handle, a great deal of drag is created, thereby making it difficult for the operator to effectively support the camera. Unacceptable vibration and movement occurs which results in a blurred image and an inability to maintain the desired aiming of the camera. When towed behind the boat, similar problems occur with vibration and aiming. Furthermore, the camera is subject to damaging entanglements and impacts with submerged devices, fishing lines, the boat or even the boat propellers.

What is lacking in the art is a means for viewing beneath the surface by use of a camera mounted in such a way that it is in visual contact with the area below the vessel and wherein the camera's angle of view can be modified for viewing the areas forward, aft, to the sides and directly beneath the vessel, while not incurring a degradation of visual acuity or suffering the type of physical damage which is concomitant with being positioned outside of the vessel.

SUMMARY OF THE INVENTION

The present invention is a video camera assembly constructed and arranged so as to be sealingly engaged with a thru-hull fitting. The assembly may take the shape of a rigid cylindrical sleeve having a proximal and a distal end and may be composed of a metal, such as aluminum, bronze, stainless steel or a particular plastic resin which has suitable characteristics, for example a glass reinforced resin.

In one embodiment, the proximal end is configured so as to have a transparent panel in sealing engagement therewith and further incorporates a positionable prism, having a reflective coating on one surface thereof, that allows aiming of the camera as desired. The transparent panel may be constructed utilizing a suitable material such as a tempered glass or PYREX® glass, a mineral material, such as fused silica, or a suitable resin such as an acrylic or polycarbonate. The transparent panel may be positioned so as to define a field of view parallel to the axis defined by the cylindrical sleeve. The sleeve is designed so as to have at least one resilient member arranged so as to sealingly and removably engage the thru-hull fitting. In a preferred embodiment, a pair of resilient O-rings are seated in grooves at the distal end of the sleeve. The resilient member may be formed from various natural or synthetic elastomers, for example nitrile rubber, fluoroelastomers and silicone. The video camera contained within said rigid cylindrical sleeve has a lens and communicating cables. One of the communicating cables provides power, generally in the form of 9.6–12 VDC. The other cable provides a video signal which may be input to a monitor or VCR. The camera is positioned so that the lens is juxtaposed the transparent panel, and may have a view of what lies directly beneath the vessel. Alternatively, the lens may be trained upon the earlier described prism, which is positioned so as to enable the camera to view any desired angle about the vessel, at an angle of declination of up to about 75° from the horizontal. The cables extend from and are sealingly engaged with the distal end of the sleeve.

In an alternative embodiment, the camera is mounted within a generally spherical enclosure having an integral transparent panel through which the video camera may be focused. The spherical enclosure, containing the video camera, is maintained in sealing engagement within a lip-sealed socket-like mounting area formed at the proximal end of the cylindrical sleeve. The lip seal may be formed from a suitable resin, for example polyurethane, effective to maintain a watertight seal while providing secure frictional engagement of the spherical enclosure. This construction allows for infinite positioning of the camera, so that the angle of view includes the area directly below and 360° about the vessel, and at an angle of declination of from about 45° to about 90° from the horizontal.

The camera assembly further includes securing means for maintaining the sleeve in sealing engagement with the thru-hull fitting. The securing means may be a threaded end cap having a surface which engages the distal end of the camera assembly and urges it into a tight engagement with the thru-hull fitting upon being threaded thereon. The camera assembly may also be constructed so as to define a plurality of circumferential flanges serially arranged and concentrically spaced along the cylindrical sleeve and having the resilient members positioned therebetween.

Thus it is an objective of the present invention to provide a video camera which may be mounted on a vessel and maintained in visual contact with the area beneath the vessel while eliminating forces which might damage the camera or otherwise reduce the visual acuity thereof.

It is a further objective of the invention to provide a video camera which can be mounted utilizing a thru-hull fitting.

It is yet another objective of the invention to provide a camera assembly having alternative fields of view, obtainable via the inclusion of a reflective prism.

It is still a further objective of the invention to provide a camera assembly having alternative fields of view, obtainable via mounting of the camera within a generally spherical mounting which is multi-positionable within an integral socket.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE PREFERRED EMBODIMENT(S)

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
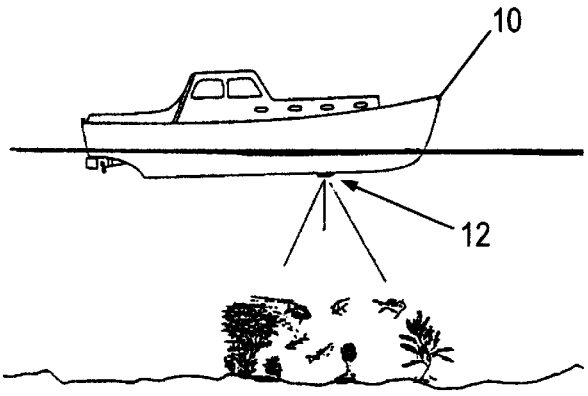
FIG. 1 is a pictorial view of the device mounted in a power boat.
Figure 1A:
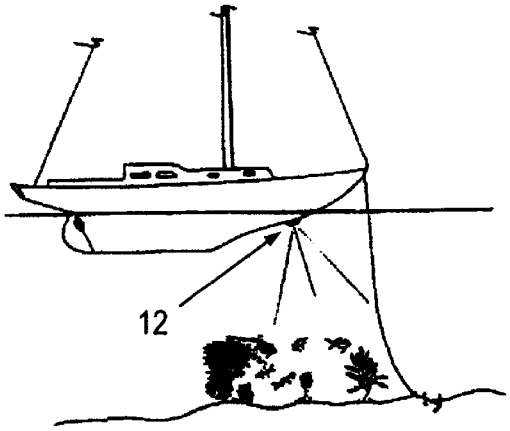
FIG. 1A is a pictorial view of the device mounted in a sailboat.

Now referring to FIG. 1, a pictorial view of a powerboat 10 is shown floating over a reef. The instant camera assembly 12 has been mounted in a thru-hull fitting of the powerboat so as to enable visualization of the area beneath the powerboat. As will be described later in this specification, the thru-hull fitting holder may be manufactured by Raytheon, Furuno, Si-Tex, Humminbird, Interphase, Apelco or the like fitting holders that are used to secure frequency sounders or the like transducers. The camera assembly, typically a miniature cylindrical style bullet camera, available from such vendors as CSI/Speco, Watec and Weldex, may be placed within a modified housing of any such thru-hull transducer style housing allowing an individual to substitute the camera assembly for a plug or operating transducer.

Unique to this invention is the ability to insert the camera assembly by removal of a conventional transducer, as described in detail later in this invention. The substitution allows for ease of installation as well as multiple uses of a thru-hull fitting. The thru-hull provides a stable viewing platform that is submersed at all times and eliminates interference from cavitation and surface debris. The use of a thru-hull further allows the camera assembly to be readily removed for service, or removed if the boat is moored for any length of time.

The removal of the camera assembly allows an uncoated viewing lens. Boats typically employ a specially formulated bottom paint tailored to prevent bottom growth wherein the paint is used to cover the exposed parts of the boat bottom including transducers. Should the boat be moored for any length of time the paint prevents the bottom growth. The removal allows the video camera to be removed while the boat is moored to prevent growth on the lens or any other type of discolorization that would affect optimum viewing without coating of the lens.

The camera assembly allows underwater viewing by use of a conventional television from the comforts of the cabin. An individual may watch the array of fish and coral beneath the boat without having to be a scuba diver or snorkeler. In addition, the actions of divers can be monitored and video taped.

The camera assembly can also be used to enhance the frequency sounder of a boat, whether it be a depth finder or a fish finder, by optical viewing. It should be noted, that water causes an increase in magnification of approximately 25% providing a natural enhancement to the viewing.

FIG. 1(*a*) depicts a sailboat having the camera assembly installed to provide all the advantages previously described and by forward placement allow the monitoring of an anchor. Since sail boaters may anchor for extended periods of time, the camera, whose field of vision is properly adjusted by manipulation of the "eyeball" socket (FIG. 6) or positioning of the prism (FIG. 8), provides a view of the anchor positioning to determine whether the anchor is dragging or snagged. It is common for a boater to drop an anchor and then jump overboard to determine if the anchor has set properly. The instant invention eliminates the need for overboard checking and allows the boater an instant way of monitoring the anchor position and determining if chaffing of the line is occurring.

Figure 2:
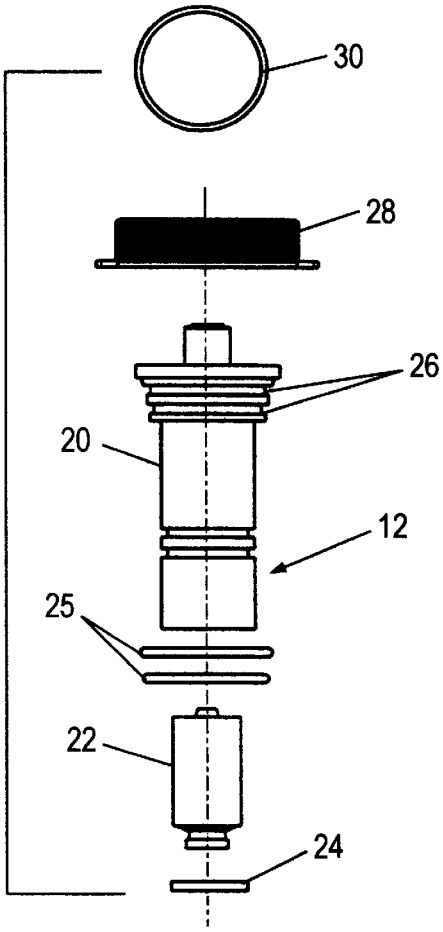
FIG. 2 is an exploded view of a particular embodiment of the device.
Figure 6:
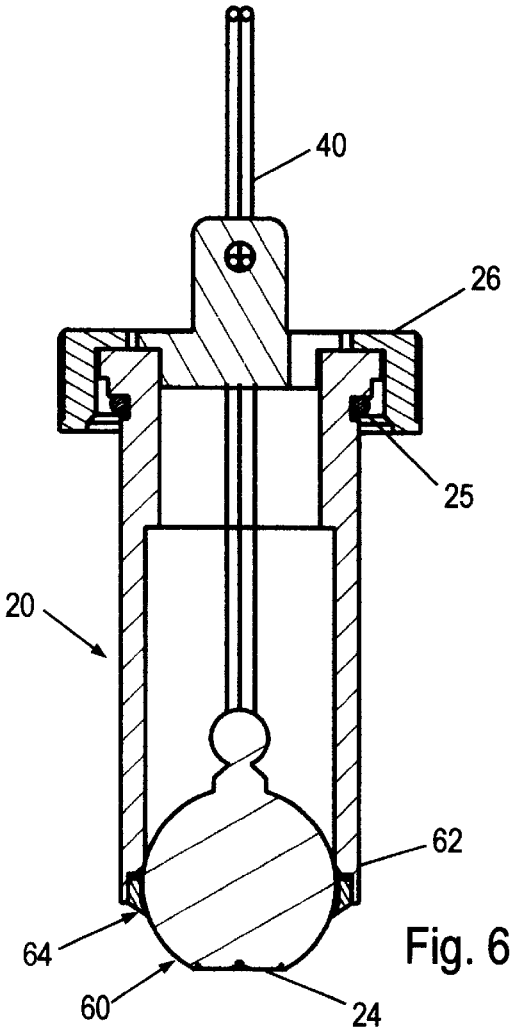
FIG. 6 is a cross-sectional view of an alternative embodiment of the device.
Figure 7:
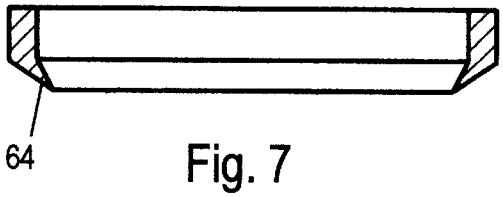
FIG. 7 is a cross-sectional view of the lip-seal in FIG. 6.

Referring to FIG. 2, the assembly 12, having a rigid cylindrical sleeve 20 is designed so as to house the camera 22. When the camera has been inserted into the sleeve, a transparent panel 24 seals the proximal end of the sleeve and allows the camera to be trained upon a visual field. Resilient members, 25 are seated in grooves 26 so as to provide a watertight seal when the assembly is inserted into a standard thru-hull fitting. End cap 28 will be threaded onto the thru-hull fitting and thereby urge the resilient members, which in a preferred embodiment are elastomeric O-rings, into sealing engagement with the thru-hull fitting. Safety ring 30 is inserted into a pre-formed hole in the distal end of the assembly and aids the technician during insertion or extraction of the assembly. The camera may be color, black/white, ultraviolet and of any processor including analog, digital, CCD or the like. As best seen in FIG. 6, the user may select the desired visual field by manipulation of the eyeball-like generally spherical camera housing 60 prior to fixing its position within the socket 62. The resilient lip-seal 64, the structure of which is more clearly shown in FIG. 7, is manufactured from a resilient material, e.g. polyurethane or the like, maintains positive pressure on the housing 60 to prevent movement while simultaneously maintaining a watertight seal about the camera's housing.

Figure 8:
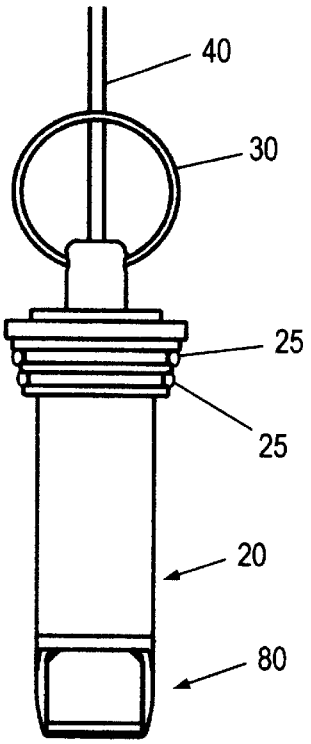
FIG. 8 is a front planar view of an alternative embodiment of the invention.
Figure 9:
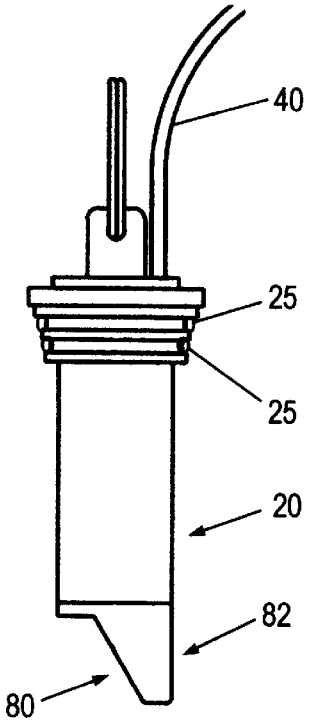
FIG. 9 is a side planar view of the embodiment of FIG. 8.

In an alternative embodiment, and as best seen in FIGS. 8 and 9, a prism 80 is appended to the sleeve's proximal end. The prism 80 may, e.g. be a Littrow prism or the like which has a reflective surface 82, and is capable of being trained in any desired direction about the vessel by rotating the cylindrical sleeve. Due to the prism's design, no inversion of the image occurs, thus the image is transmitted to the viewing device in the orientation in which it is seen, and may be viewed without reversion. This configuration permits a field of view which is diverted, at an angle of declination of up to about 75° from the horizontal. Although any angle of declination is possible, the instant inventor has found that diversion of the beam at a 60° angle of declination from the horizontal offers suitable viewing of a majority of the water column.

Figure 3:
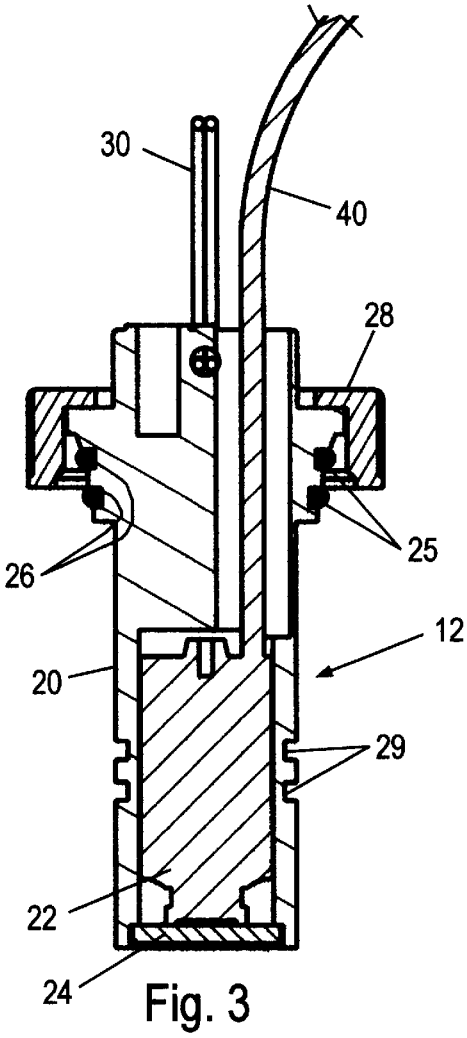
FIG. 3 is cross-sectional view of one embodiment of the device.

Referring now to FIG. 3, set forth is a cross-sectional view of the assembly 12 wherein the cylindrical sleeve 20 has been modified to have a lower hollowed section for placement of a miniaturized camera 22. The camera is sized to frictionally engage the side-walls of the cavity or be epoxied in position with placement of the transparent viewing panel 24, which seals the proximal end of the housing 20. Electrical wiring 40 extends through an upper cavity for use in connecting to the power source and video output such as a television camera. The wire 40 is also sealed in place providing a permanent solid seal in the thru-hull housing with sealing provided by O-rings 25 and, depending upon the thru-hull fitting, grooves 29 are optionally available for additional O-rings providing a water tight seal in the side surface of the boat and the water.

Figure 4:
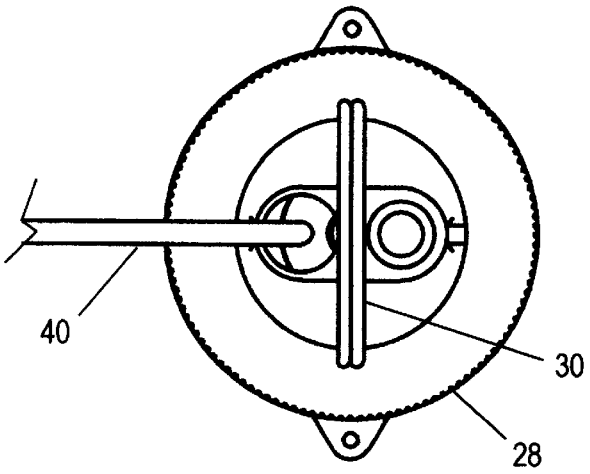
FIG. 4 is a top-view of the device.
Figure 4A:
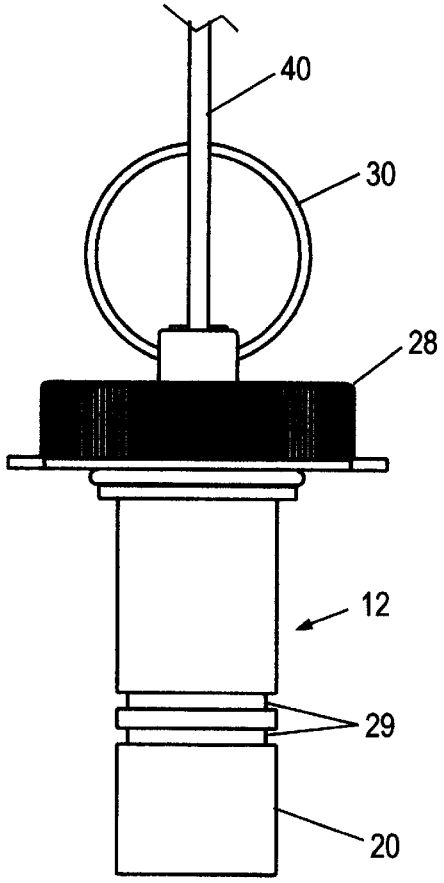
FIG. 4A is a side view of the camera assembly.
Figure 4B:
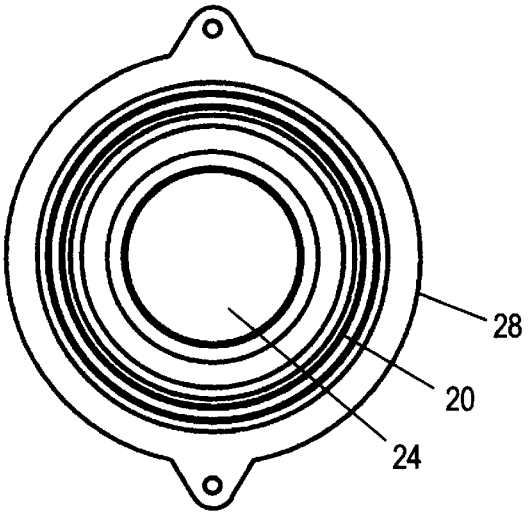
FIG. 4B is an end view of the camera assembly.

Referring to FIG. 4, this figure shows a top view of the assembly wherein the cables 40 exit from an aperture in the top of the distal end of the sleeve 20. The cables may be sealed within the aperture by use of a potting material, such as an epoxy or urethane resin. In an alternative embodiment, a resilient grommet (not shown) may be utilized which surrounds the cable and is compressed so as to sealingly engage said aperture.

FIG. 4(*a*) sets forth a side view of the camera assembly 12. In the assembled form, the camera looks exactly like any other type of transducer set through a thru-hull fitting except for the viewing panel 24 located on the end of the housing 20. It is noted, that the viewing panel can be easily cleaned by removal of the assembly 12 by un-threading cap 28 and simply removing the assembly from the thru-hull fitting. This operation can be done while in the water as an experienced individual can easily withdraw an assembly and insert a new transducer or plug in its place while servicing of the camera is performed.

Figure 5:
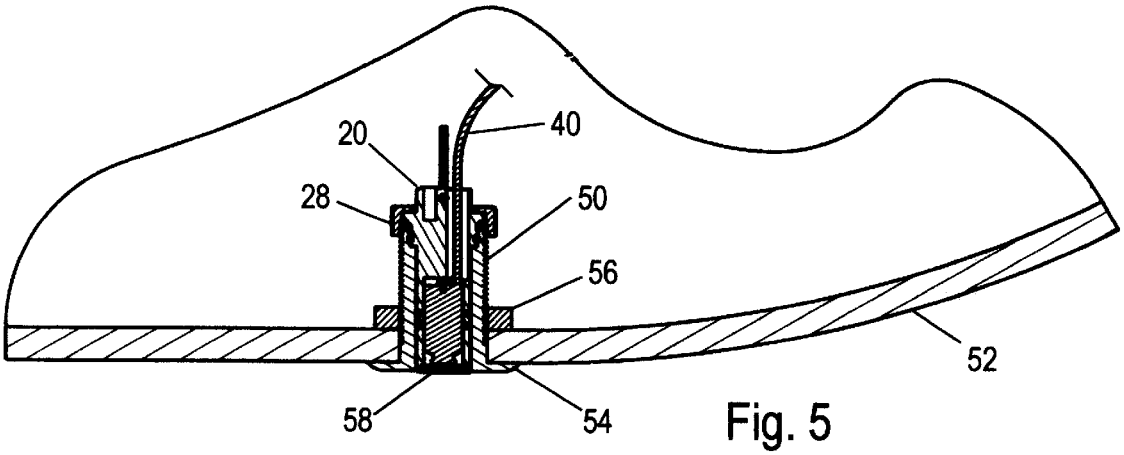
FIG. 5 is a cross-sectional view of one embodiment of the device mounted through the hull of a vessel.

Referring to FIG. 5, the sleeve 20 is shown inserted into a thru-hull fitting 50 and urged into a sealing engagement therewith by end cap 28. The cables 40 are then routed to a power source and video display within the vessel. The thru-hull fitting 50 typically includes a bronze or non-ferrous external coupling 54 which is operatively associated with an internal coupling 56 for holding of a threaded sleeve 58. Once installed, the thru-hull fitting 50 is permanently secured to the hull and removed only if a thru-hull fitting should crack or otherwise deteriorate. The thru-hull fitting 50 provides a stable base for the camera assembly.

The camera assembly may have a field of view in a direction parallel to the axis of the sleeve or be predisposed at an angle that exemplifies the optimum viewing angle beneath a boat, such as 30 degrees. The actual viewing angle may be between 0 and 90 degrees and the device may include a means for rotation and angular positioning of the camera. In this manner, a dive boat could employ the instant invention and include a provision for rotation of the camera to allow viewing of the propeller and dive platform area of the boat. Inexperienced divers or divers boarding a boat in high seas can easily be injured by the movement of the swim platforms and propeller and this area requires careful monitoring. Angular positioning further allows a dive boat to monitor the divers location while beneath the boat as well as search for lost divers.

Figure 10:
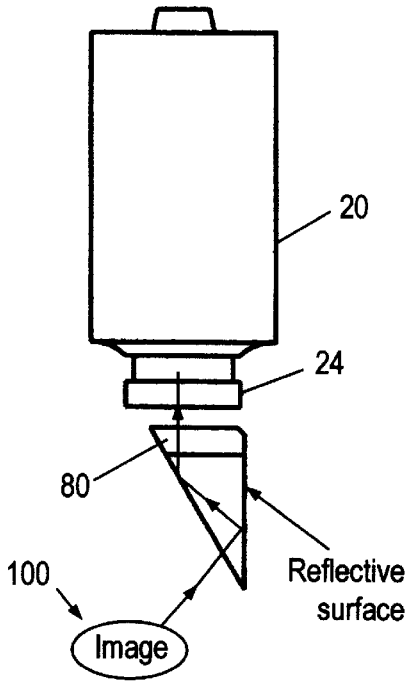
FIG. 10 is a diagram showing the light path through a reflective prism.
Figure 11:
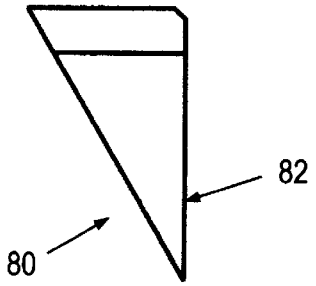
FIG. 11 is a side planar view of the prism.
Figure 12:
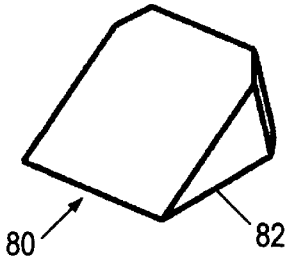
FIG. 12 is a perspective view of the prism.

Now referring to FIGS. 10,11 and 12, the cylindrical housing 20 is generally shown having a transparent panel 24 followed by a prism 80. Light reflected from an image 100, travels toward the prism 80, where it is transmitted to the reflective surface 82 and internally reflected toward the transparent panel 24 and into the camera (not shown). The prism is shown in a side planar view in FIG. 11 and in a perspective view in FIG. 12.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

I claim:

1. A video camera assembly constructed and arranged so as to be sealingly engaged with a thru-hull fitting and comprising: a rigid cylindrical sleeve having a proximal and a distal end; said proximal end having a transparent panel sealing engagement therewith; said distal end arranged so as to sealingly and removably engage said thru-hull fitting; a resilient member constructed and arranged so as to provide a watertight seal between said thru-hull fitting and said assembly; a video camera contained within said rigid cylindrical sleeve and having a lens and communicating cables, said camera being positioned such that said lens is juxtaposed said transparent panel and said cables extend from and are sealingly engaged within said distal end; and further including means to adjust said lens' field of view; said means to adjust the field of view is a generally spherical enclosure constructed and arranged to contain a video camera having said transparent panel integral therewith and through which the video camera may be focused; whereby the spherical enclosure, containing the video camera, is maintained in sealing engagement within a lip-sealed socket-like mounting area formed at the proximal end of the cylindrical sleeve which provides secure frictional engagement of the spherical enclosure; and wherein the camera is positionable so that the field of view includes the area directly below and 360 about.

2. The camera assembly according to claim 1, further including securing means for maintaining said sleeve in sealing engagement with said thru-hull fitting.

3. The camera assembly according to claim 2, wherein said securing means is a threaded end cap.

4. The camera assembly according to claim 1, wherein said distal end defines a plurality of circumferential flanges serially arranged and concentrically spaced along said cylindrical sleeve and having at least one of said resilient members positioned therebetween.

5. The camera assembly according to claim 1, wherein the field of view encompasses an area at an angle of declination of from about 45° to about 90° from the horizontal.

6. The camera assembly according to claim 1, wherein the assembly is constructed from a material selected from the group consisting of aluminum, stainless steel, bronze, a particular plastic resin or combinations thereof.

7. The camera assembly according to claim 1, wherein the transparent panel is constructed from a material selected from the group consisting of glass, a mineral material or an acrylic or polycarbonate resin.

8. The camera assembly according to claim 1, wherein the resilient member is constructed from a material selected from the group consisting of natural or synthetic elastomers.

9. The camera assembly according to claim 1, wherein the resilient member is constructed from a material selected from the group consisting of nitrile rubber, fluoroelastomers and silicone.

10. A video camera assembly constructed and arranged so as to be sealingly engaged with a thru-hull fitting and comprising: a rigid cylindrical sleeve having a proximal and a distal end; said proximal end having a transparent panel in sealing engagement therewith; said distal end arranged so as to sealingly and removably engage said thru-hull fitting and said assembly; a video camera contained within said rigid cylindrical sleeve and having a lens and communicating cables, said camera being positioned such that said lens is juxtaposed said transparent and said cables extend from and are sealingly engaged within said distal end; and further including means to adjust said lens' field of view; said means to adjust the field of view is a positionable prism formed integral with the proximal end of said cylindrical sleeve and characterized as having a reflective coating on one surface thereof; said prism being constructed and arranged such that any desired direction for the field of view is achieved by rotation of the cylindrical sleeve.

11. The camera assembly according to claim 10, wherein the field of view encompasses an area at an angle of declination of up to about 75° from the horizontal.

12. A video camera assembly constructed and arranged so as to be sealingly engaged with a thru-hull fitting in a vessel and comprising: a rigid cylindrical sleeve having a proximal and a distal end; said proximal end having a transparent panel in sealing engagement therewith; said distal end arranged so as to sealingly and removably engage said thru-hull fitting; a threaded end cap for releasably securing said sleeve to said thru-hull fitting; a resilient member constructed and arranged so as to provide a watertight seal between said thru-hull fitting and said assembly; a video camera contained within said rigid cylindrical sleeve and having a lens and communicating cables, said camera being positioned such that said lens is juxtaposed said transparent panel and said cables extend from and are sealingly engaged within said distal end; and further including means to adjust said lens' filed of view wherein said means to adjust the field of view is a generally spherical enclosure constructed and arranged to contain a video camera having said transparent panel integral therewith and through which the video camera may be focused; whereby the spherical enclosure, containing the video camera, is maintained in sealing engagement within a lip-sealed socket-like mounting area formed at the proximal end of the cylindrical sleeve which provides secure frictional engagement of the spherical enclosure; and wherein the camera is positionable so that the field of view includes the area directly below and 360 about the vessel.

13. The camera assembly according to claim 12, wherein the assembly is constructed from a material selected from the group consisting of aluminum, stainless steel, bronze, a particular plastic resin or combinations thereof.

14. The camera assembly according to claim 12, wherein the transparent panel is constructed from a material selected from the group consisting of glass, a mineral material or an acrylic or polycarbonate resin.

15. The camera assembly according to claim 12, wherein the resilient member is constructed from a material selected from the group consisting of natural or synthetic elastomers.

16. The camera assembly according to claim 12, wherein the resilient member is constructed from a material selected from the group consisting of nitrile rubber, fluoroelastomers and silicone.

17. The camera assembly according to claim 12, wherein the field of view encompasses an area at an angle of declination of from about 45° to about 90° from the horizontal.

18. A video camera assembly constructed and arranged so as to be sealingly engaged with a thru-hull fitting in a vessel and comprising: a rigid cylindrical sleeve having a proximal and a distal end; said proximal end having a transparent panel in sealing engagement therewith; said distal end arranged so as to sealingly and removably engage said thru-hull fitting; a threaded end cap for releasably securing said sleeve to said thru-hull fittin; a resilient member constructed and arranged so as to provide a watertight seal between said thru-hull fitting and said assembly; a video camera contained within said rigid cylindrical sleeve and having a lens and communicating cables, said camera being positioned such that said lens is juxtaposed said transparent panel and said cables extend from amd are sealingly engaged within said distal end; and further including means to adjust said lens' field of view wherein said means to adjust the field of view is a positionable prism formed integral with the proximal end of said cylindrical sleeve and characterized as having a reflective coating on one surface thereof; said prism being constructed and arranged such that any desired direction about the vessel for the field of view is achieved by rotation of the cylindrical sleeve.

19. The camera assembly according to claim 18, wherein the field of view encompasses an area at an angle of declination of up to about 75° from the horizontal.

* * * * *